United States Patent [19]

Ronai

[11] 4,037,977

[45] July 26, 1977

[54] MASSAGE AND DISPENSING APPARATUS

[76] Inventor: Anne A. Ronai, c/o Thomas Ronai, Hideca, Apartado, 68658 Caracas, Venezuela

[21] Appl. No.: 652,857

[22] Filed: Jan. 27, 1976

Related U.S. Application Data

[63] Continuation-in-part of Ser. No. 539,712, Jan. 9, 1975, abandoned.

[51] Int. Cl.[2] ..... A45D 33/12

[52] U.S. Cl. ..... 401/209

[58] Field of Search ..... 401/213, 214, 219, 215, 401/216, 217, 209; 222/370

[56] References Cited

U.S. PATENT DOCUMENTS

| | | | |
|---|---|---|---|
| 1,089,683 | 3/1914 | Stapler | 401/215 |
| 2,103,261 | 12/1937 | Hughes | 401/216 X |
| 2,709,432 | 5/1955 | Ackerman | 401/217 |

*Primary Examiner*—Stanley H. Tollberg
*Attorney, Agent, or Firm*—Cushman, Darby & Cushman

[57] ABSTRACT

A dispenser and massage with one or more applicator aperture in the bottom of a housing to dispense, as the ball massages a body portion, lotion or powder from a dispensing chamber formed between the housing bottom and an insert which forms a bearing for the ball. The insert divides the space above the dispensing chamber between the insert and a lid into separate lotion and powder chambers with each connected to the dispensing chamber by an aperture in the insert. Also, separate valve mechanisms control the flow of powder and lotion, each including an apertured valve portion disposed over the insert aperture for blocking or permitting flow therethrough, a knob extending through a lid for rotating the valve portion through a stem and a spring urging the valve portion against the insert. In a first embodiment the lid is snapped in place over resilient ribs. In a second embodiment, the lid is threaded and screwed down in roughly one quarter turn. In a third embodiment, a rectangular lid is slid in place over an insert. The dispenser can have a rectangular, square, round or oval configuration.

11 Claims, 13 Drawing Figures

Fig. 8
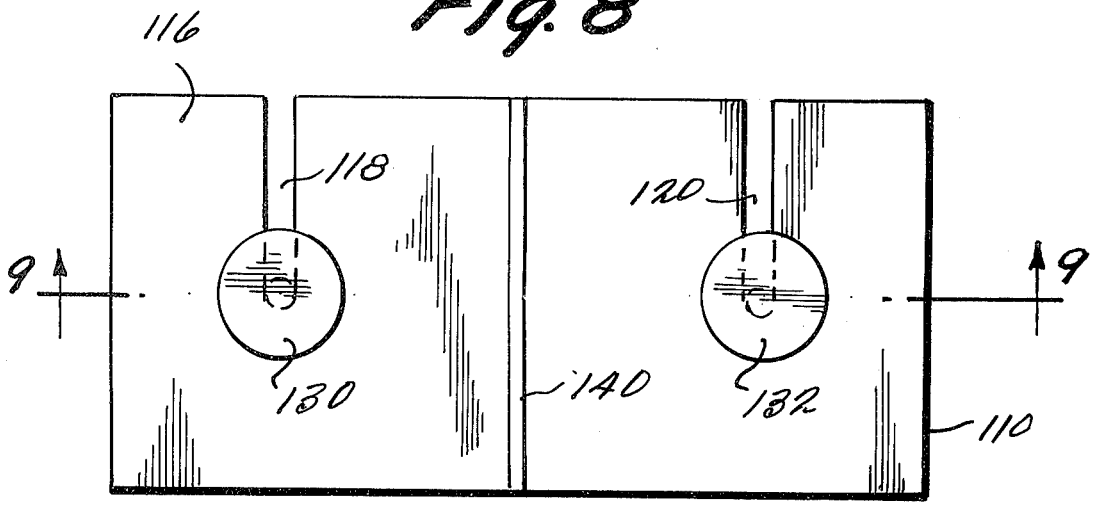
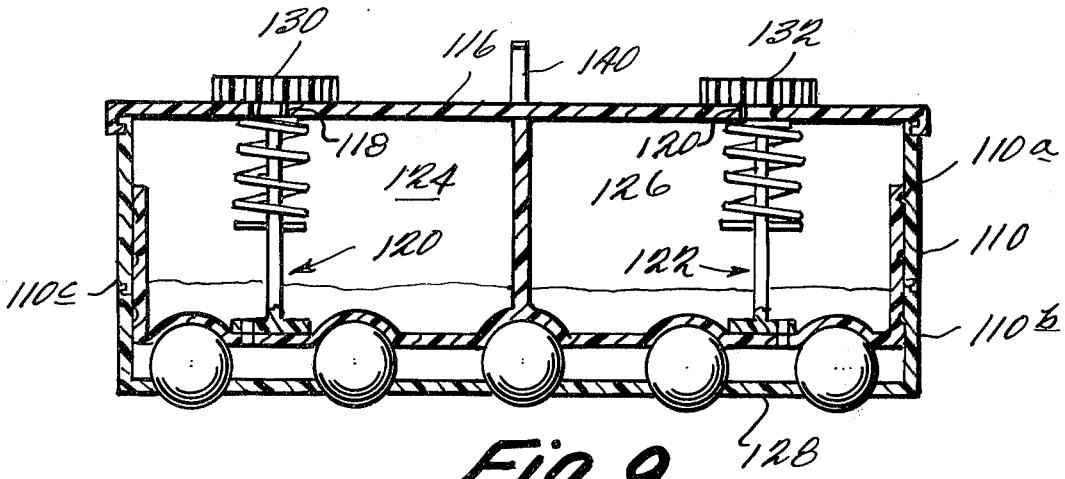
Fig. 9
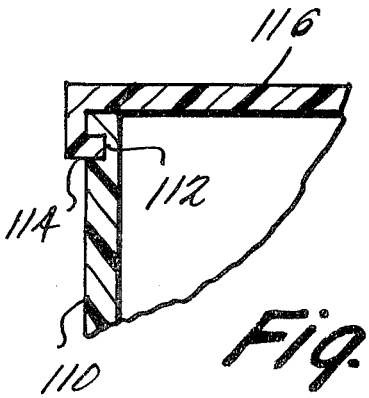
Fig. 10
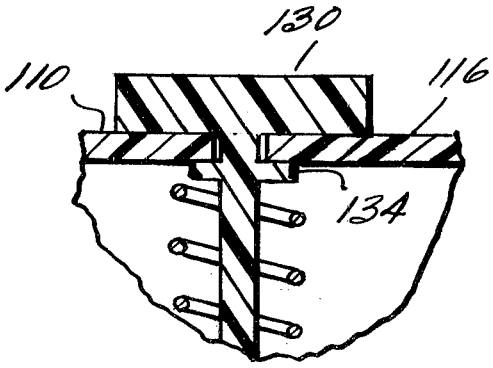
Fig. 11

MASSAGE AND DISPENSING APPARATUS

PRIOR ART AND SUMMARY OF THE INVENTION

This application is a continuation-in-part of Ser. No. 539,712, filed Jan. 9, 1975 (now abandoned).

The invention relates to a unique dispenser and massager.

Massaging or kneading various parts of the body is one of the most pleasant and sensuous ways of relaxing. It is desirable to obtain even sensations in various directions on the body at the same time without much effort. That sensation is achieved by multiple and unrestricted rotation of the balls and their combination. Often it is desirable to combine mechanical manipulations with application of lotion or powder. However, simply pouring a large quantity of powder or lotion onto a body portion then spreading the liquid or powder by massage is not always a satisfactory technique.

The present invention relates to a unique massager and dispenser whereby the rotation of a combination of balls gives a maximum sensation and in addition, powder, lotion or other material can be dispensed in small quantities by an applicator having one or more balls for dispensing onto the body while the ball applicator itself provides a pleasant massage and may be helpful in stimulating circulation. The unit can be used by an individual on various parts of his or her own body or can be used on various parts of the body of another person to produce a unique sensation by multiple and unrestricted rotation of the balls and their combination. The unit is of simple construction and can be made easily and inexpensively.

As described in detail below, according to one embodiment of this invention, the applicator balls ride in a hole in the bottom of a molded or otherwise formed resilient plastic housing. Each ball is formed and the diameters of the bore and ball are chosen in a manner which is well known in the art of ball application. The applicator is held in place by an insert which preferably engages, by means of ribs or the like, the interior of the molded housing and forms a bearing for the ball applicator as well as a dispensing chamber between the housing bottom and insert. The resilient insert snaps or slides into place.

The space above the insert is divided by an integral partition of the insert into two separate chambers, one preferably storing a suitable body powder and the other a suitable body lotion. The insert is provided with separate holes connecting the chamber which contains the powder and the chamber which contains the lotion to the dispensing chamber for permitting either the powder or the lotion to filter into the dispensing chamber between the insert and the bottom of the housing where the applicator is located. Material which is thus filtered into the dispensing chamber is conventionally applied by the applicator as it is rotated over a portion of a body.

The respective holes in the insert are preferably open and closed by a valve mechanism which includes a portion engaging the bottom of the insert over the respective holes in each of the chambers and which includes a stem extending upwardly through a lid which covers the top of the housing. A knob exterior to the lid can be rotated to rotate the stem and the valve portion thereof to align or misalign the respective holes in the insert and the valve portion to either block flow of the powder or lotion or to permit flow thereof. A spring urges the valve portion into close engagement with the insert. Any number of applicator balls can be provided in the unit and the balls can be made in different textures, for example rough and smooth, as desired. It may be desirable from time to time to change the ball for different types of massage.

In one further embodiment, the lid is threaded to be locked to the housing in one quarter turn or less. In a second further embodiment, the housing is rectangular with a slide-on lid and provided with a great number of applicator balls. There are different ready attachments with different combinations of balls, bristles, etc., from different materials like nylon, plastic, etc., which could slide in for different requirements. Those attachments would also differ in sizes of the balls.

Many other objects and purposes of the invention will be clear from the following detailed description of the drawings.

BRIEF DESCRIPTION OF THE DRAWINGS

FIG. 8 shows a top view of a further embodiment having a slide-on lid, and a plurality of balls.

FIG. 9 shows a sectional view of FIG. 8 along the lines 9—9.

FIG. 10 shows a partial sectional view of the lid and housing of the arrangement of FIG. 8.

FIG. 11 shows a partial view of the lid and valve mechanism of the arrangement of FIG. 8.

DETAILED DESCRIPTION OF THE DRAWINGS

Figure 1:
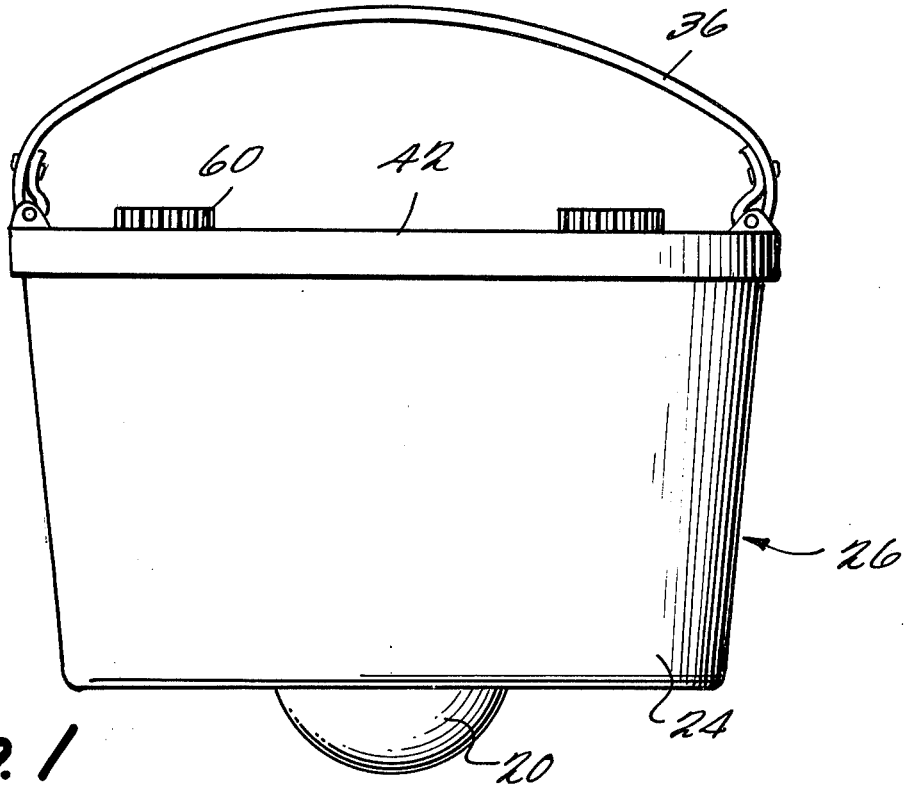
FIG. 1 shows a side view of the unique applicator and massager of this invention.
Figure 2:
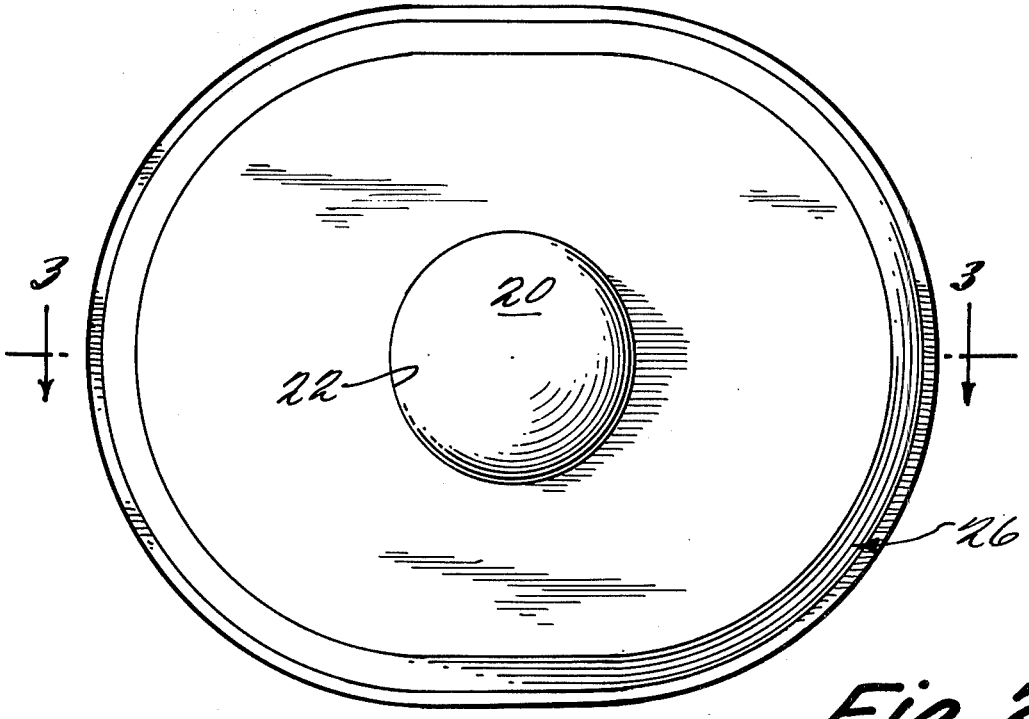
FIG. 2 shows a bottom plan view of the applicator of FIG. 1.
Figure 3:
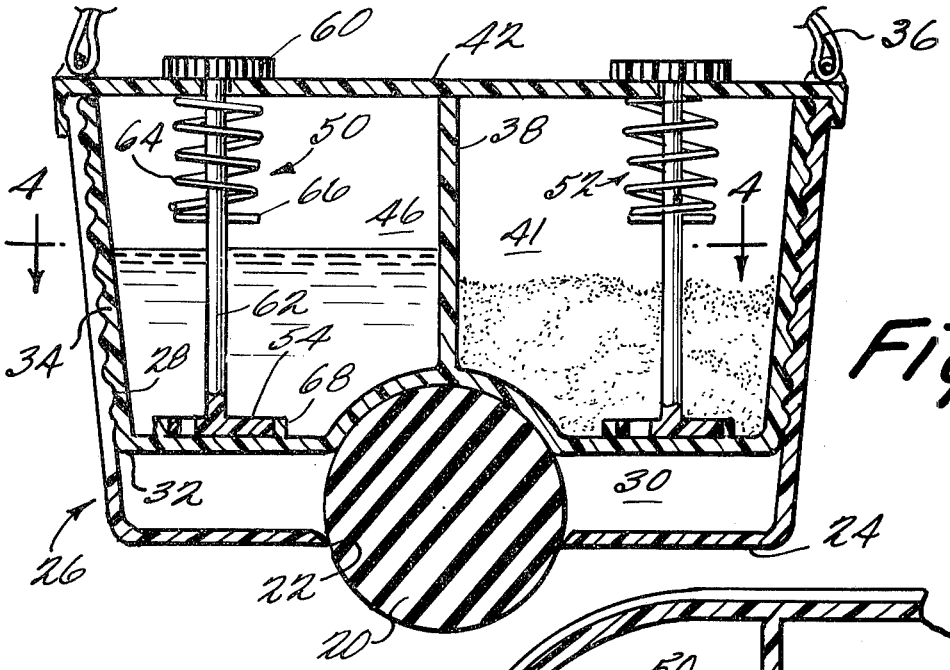
FIG. 3 shows a view of the applicator of FIGS. 1 and 2 along the lines 3—3 of FIG. 2.

Reference is now made to FIGS. 1-4 which illustrate a first embodiment of the invention. As discussed briefly above, a conventional applicator ball 20 extends partially through an aperture 22 in the bottom surface 24 of housing 26. Housing 26 may be formed of any suitable material and in any suitable way, but is preferably formed of molded, resilient plastic having an inner ribbed surface 28 as can be best seen in FIG. 3. Applicator ball 20 when rotated by movement along a body surface dispenses liquid or powder in the dispensing chamber 30 formed between the bottom surface 24 of housing 26 and the bottom 32 of insert 34. Insert 34 is, like housing 26, preferably formed of molded or other suitable material, and has a ribbed portion engaging ribs 28 of housing 26, so that the insert is held innplace as illustrated in FIG. 3 bearing against applicator ball 20 and holding it in position so as to properly dispense material in chamber 30. The insert and housing are sufficiently resilient to be slid into the illustrated position. Strap 36 can be used to hold the massager on the hand during use.

Insert 34 is divided by an integral partition 38 into two chambers 40 and 41. One of these chambers preferably contains a suitable body powder while the other contains a suitable body lotion. The top of housing 26 is covered by a snap-on lid lid 42 so that more powder or lotion can be added to the massage unit by simply removing the snap-on lid 42. Lid 42 may similarly be constructed of any suitable material such as molded plastic.

Figure 4:
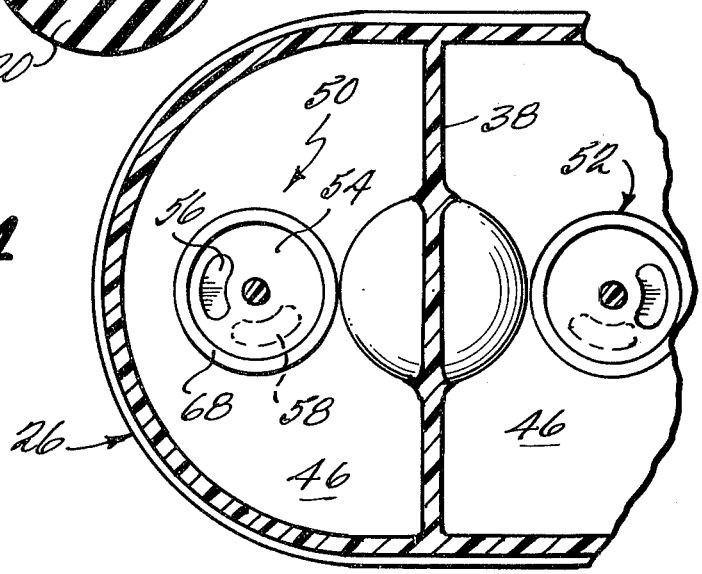
FIG. 4 shows a sectional view of the applicator of FIGS. 1-3 along the lines 4—4 of FIG. 3.

Flow of the lotion or powder from chambers 40 and 41 into chamber 30 is controlled by two identical valves 50 and 52. It is contemplated that one of these valves will be in an open position dispensing either powder or lotion while the other is closed. Valve 50 includes a lower valve portion 54 which, as can be seen in FIG. 4, has a half moon shaped aperture 56 extending therethrough. When aperture 56 in valve portion 54 is aligned with aperture 58 in the bottom of 32 of insert 34, the material in chamber 40 will flow through the aligned apertures 56 and 58 into chamber 30 hence to be dispensed by ball applicator 20. A knurled knob 60 exterior to the lid 42 is connected to valve portion 54 by stem 62 so that the position of valve portion 54 can be adjusted by rotating knob 60. Preferably an indication is provided on the exterior of the unit as to the open and closed positions associated with the various positions of knob 60. Spring 54, engaging stop 66 of stem 62, urges the valve downward so that the portion 54 is kept in firm connection with the bottom 32 of insert 34. Annular ring 68 formed in insert 34 prevents the portion 54 from being mislocated and permits that portion to be easily relocated when the lid 42 is removed to add additional powder or lotion. It is contemplated that valves 50 and 52 will be removed with the lid when the powder or lotion is to be replenished. The valves can also be formed of molded plastic.

It will, of course, be understood that any alternative valve arrangements for dispensing fluids can be used in place of the valves 50 and 52 illustrated in FIGS. 1–4.

Figure 5:
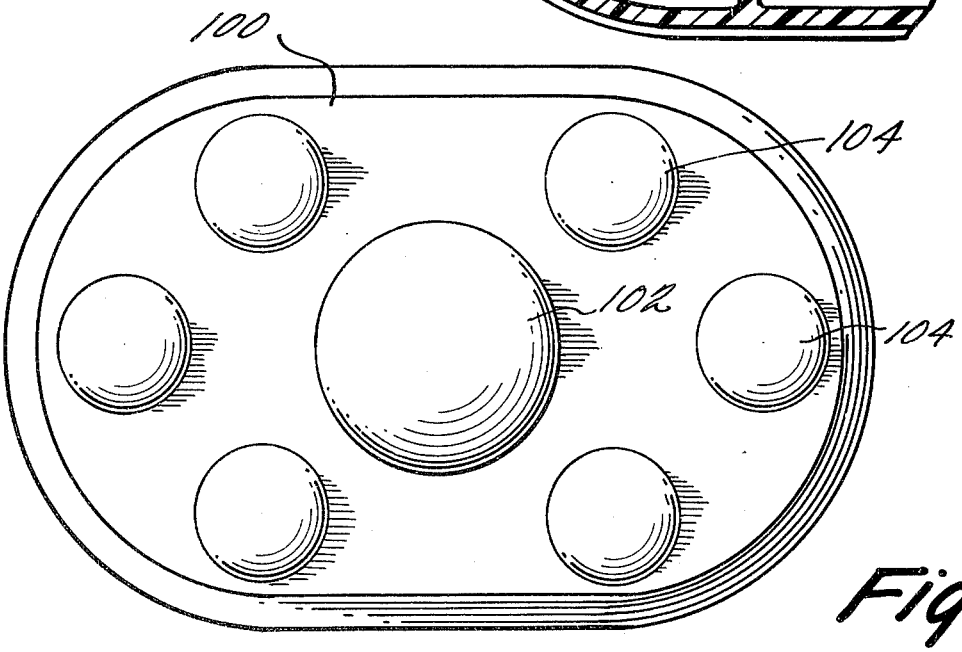
FIG. 5 shows a plan view of a further embodiment of the invention employing a plurality of applicator balls.

FIG. 5 illustrates a further embodiment of the invention in which the bottom 100 of the housing is provided with a plurality of apertures each receiving an applicator ball. In the arrangement of FIG. 5, a center applicator ball 102 is surrounded by a plurality of satellite balls 104 of smaller diameter. It will, of course, be understood that any suitable number of applicator balls can be used if desired.

Figure 6:
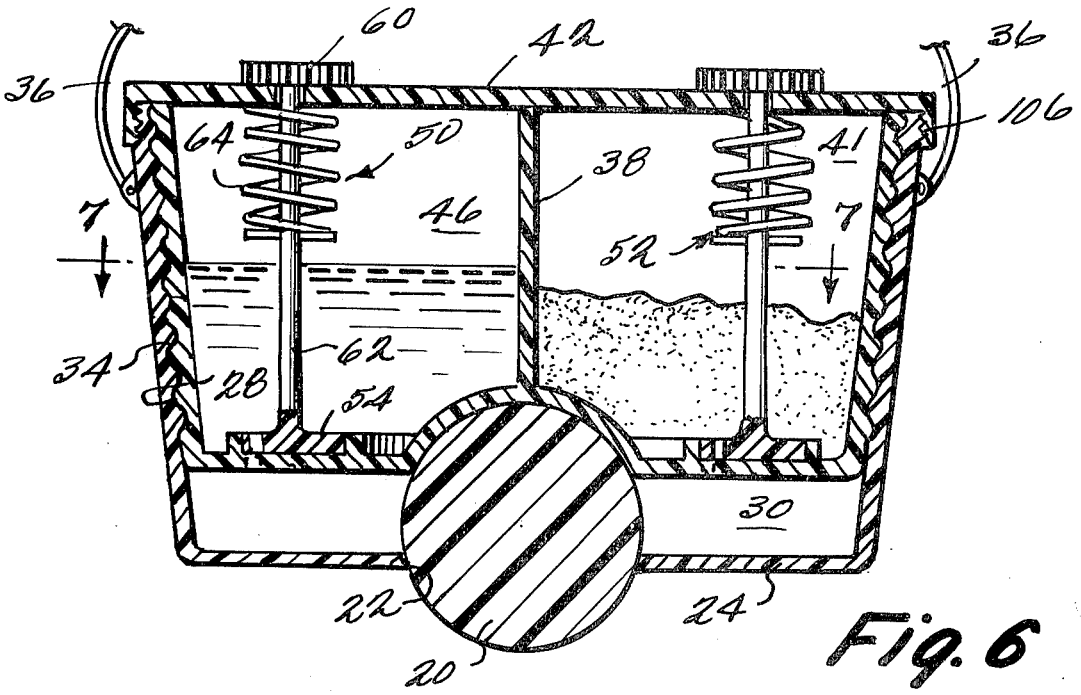
FIG. 6 shows a sectional view of a further embodiment with a screw-on lid.
Figure 7:
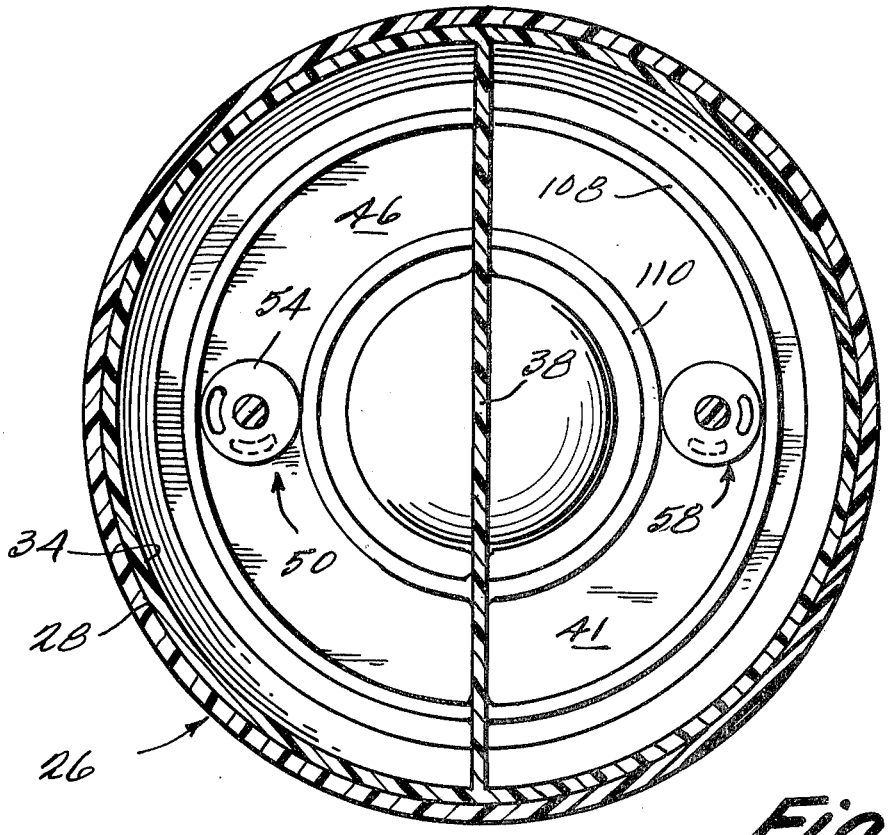
FIG. 7 is a sectional view through the lines 7—7 in FIG. 6.

FIGS. 6 and 7 illustrate a further embodiment of this invention which is identical to the arrangement of FIGS. 1–4 except that (a) the lid 42 is provided with threads 106 which engage threads formed on the upper outer edge of housing 26 (b) lid 42, housing 26 and insert 34 have a round rather than oval configuration, (c) annular ribs 108 and 110 extend upward from the bottom of insert 34 to guide the portions 54 of valves 50 and 52 into position, and (d) strap 36 is attached to frame 34 rather than lid 42. The numbers of FIGS. 6 and 7 are otherwise the same as in FIGS. 1–4.

The threads 106 are arranged to lock lid 42 firmly in place with valves 50 and 52 correctly positioned in one quarter turn or less to avoid interference with partition 38.

FIGS. 8–11 illustrate a further embodiment with a number of balls of any size and number from a few to many mounted in a housing having a rectangular cross section. The insert is, of course, shaped in accordance with the number of and size of the balls. As best seen in FIG. 10, housing 110 has a groove 112 formed thereon near the top edge along two sides in which slides a tongue portion 114 of lid 116. Lid 116 further has grooves 118 and 120 cut in the upper surface to permit removal of lid 116 to add more lotion or powder and replacement thereof without removing valves 120 and 122. Valves 120 and 122 each include knurled knobs 130 and 132, respectively, which can be rotated to open and close the respective openings between chambers 124 and 126 and chamber 128, as shown in FIG. 4. Referring to FIG. 11, each valve has ridge 134 beneath lid 116 which prevents removal thereof when lid 116 is properly in place. Lid 116, housing 110, and valves 120 and 122 are all preferably formed of resilient plastic. Strap 140 is grasped to use the massage.

Referring to FIG. 9, housing 110 is preferably formed into two parts **110*a* and 110*b* which slide together with a snap or latch closure if desired. Lower part 110*b* can be replaced with another part (not shown) which mounts bristles, or other shaped massaging structure. Parts 110*a* and 110*b* have matching tongue and groove sections 110*c* which extend along the opposite sides of housing 110, as shown in FIG. 9.**

Figure 12:
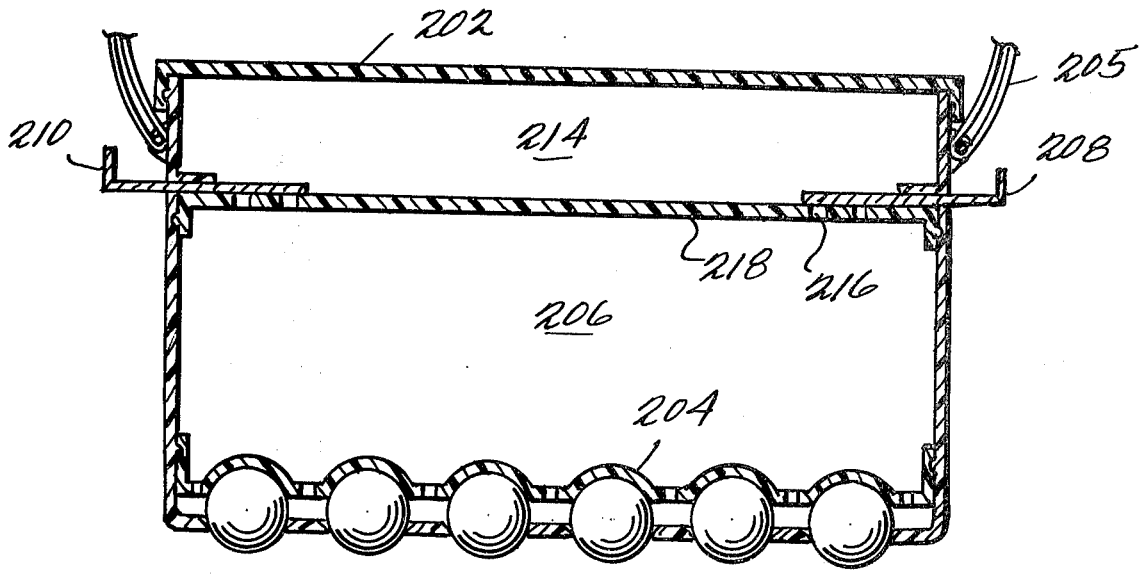
FIG. 12 shows a sectional view of a further embodiment having a different valve arrangement.

FIG. 12 shows a further embodiment which dispenses only one material, e.g., oil. Housing 200 is square in cross section with a slide-on lid 202, as illustrated in FIGS. 8–11, and a plurality of balls extending through apertures in the housing bottom and held in place by a plastic bearing insert 204, which is in turn held in place in any suitable way, e.g., as described above. Insert 204 has a plurality of openings therethrough for permitting material to flow readily from chamber 206 and be dispensed. Strap 205 is attached to housing 200.

Figure 13:
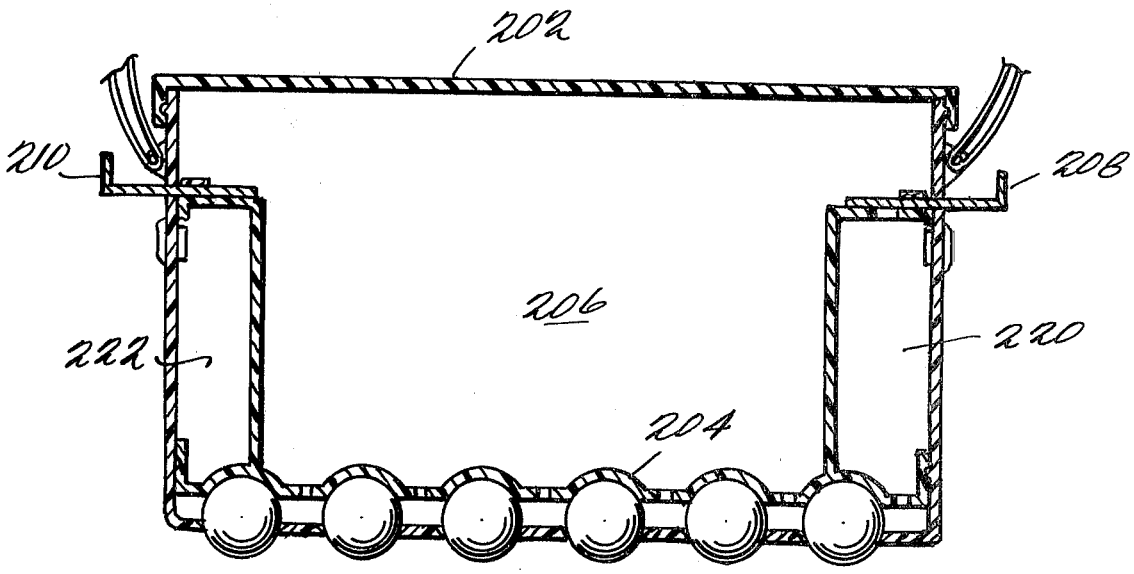
FIG. 13 shows a sectional view of a further embodiment for dispensing oil or powder through a sliding valve.

In FIGS. 12 and 13, two valve members 208 and 210 control flow of material between upper chamber 214 and lower chamber 206. Valve 208 can be moved upward manually in a slot in the outside of housing 200 to uncover apertures 216 in insert 218. Rails or the like hold the valve in the open and closed positions in a fashion which is well known in molding plastic containers, such as transistor radio cases. Lid 202 and insert 218 can be formed as a unit if desired. Otherwise, the arrangements are as described above. The lower part of housing 200 can be separable, as above, to accommodate different attachments, if desired.

In FIG. 13, two separate chambers 220 and 222 hold two different materials, e.g., oil and lotion. Valves 224 and 226 are identical to valves 200 and 210 in FIG. 12.

Many other changes and modifications in the above described embodiment of the invention can, of course, be carried out without departing from the scope thereof. The valve arrangements can be replaced by a lever-operated closure extending through a slot in the housing side to cover and uncover holes in the insert as it is moved up and down by the lever arm. The insert can be adjacent the lid defining a chamber between lid and insert. Any other valve arrangements can be used. Any material can be dispensed. The unit can be used for massaging without dispensing, if desired. Accordingly, that scope is intended to be limited only by the scope of the appended claims.

What is claimed is:

1. A massager and dispenser apparatus comprising:

a housing having an open top and a bottom surface with an aperture extending therethrough, an applicator ball extending partially through said aperture, an insert member disposed in said housing for holding said applicator ball in a dispensing position, forming a dispensing chamber between said housing bottom and said insert and forming first and second storage chambers above said dispensing chamber, said insert having at least first and second apertures therein connecting first and second chambers respectively to said dispensing chamber, a lid member closing the top of said housing and said first and second chambers, first valve means having a valve portion engaging said insert adjacent said first aperture so as to prevent, in a first position, movement of material into said dispensing chamber from said first chamber and to permit, in a second position, movement of material into said dispensing chamber and a knob portion extending through said lid for manually shifting said valve portion between said positions, and second valve means having a portion engaging said insert adjacent to said second aperture so as to prevent, in a first position, movement of material into said dispensing chamber from said second chamber and in a second position movement of material into said dispensing chamber and a portion extending through said lid for manually shifting said valve portion of said second valve means between said positions.

2. An apparatus as in claim 1 wherein said housing and insert have a round cross-section and the sides of said insert member and the sides of said housing are threaded to engage.

3. An apparatus as in claim 1 further including a hand strap connected to said housing.

4. An apparatus as in claim 1 wherein said lid member snaps over the open top of said housing.

5. An apparatus as in claim 1 including a plurality of applicator balls each extending through a separate aperture in the bottom of said housing.

6. An apparatus as in claim 1 wherein said housing and insert member are molded plastic.

7. An apparatus as in claim 1 wherein said insert member includes an integral partition extending upward to separate said first and second chambers.

8. An apparatus as in claim 1 wherein said first and second valve means each have an aperture extending through said valve portion, a stem extending between said valve portion and said knob portion and having a stop and a spring engaging said stop to urge said valve portion against said insert.

9. An apparatus as in claim 1 further including body powder in said first chamber and lotion in said second chamber.

10. An apparatus as in claim 1 wherein said housing and insert have a rectangular cross section.

11. An apparatus as in claim 10 wherein said housing has a pair of grooves extending along the top edge of opposite sides thereof and said lid member has a tongue engaging said groove.

* * * * *